US007658833B2

(12) United States Patent
Robinson et al.

(10) Patent No.: US 7,658,833 B2
(45) Date of Patent: Feb. 9, 2010

(54) METHOD FOR COPPER ELECTROWINNING IN HYDROCHLORIC SOLUTION

(75) Inventors: Douglas J. Robinson, Phoenix, AZ (US); Stacey A. MacDonald, Phoenix, AZ (US); Vladimir Jiricny, Suchdol (CS)

(73) Assignee: De Nora Elettrodi S.p.A., Milan (IT)

( * ) Notice: Subject to any disclaimer, the term of this patent is extended or adjusted under 35 U.S.C. 154(b) by 686 days.

(21) Appl. No.: 10/547,520

(22) PCT Filed: Mar. 2, 2004

(86) PCT No.: PCT/EP2004/002092

§ 371 (c)(1),
(2), (4) Date: Sep. 22, 2005

(87) PCT Pub. No.: WO2004/079052

PCT Pub. Date: Sep. 16, 2004

(65) Prior Publication Data

US 2006/0163082 A1 Jul. 27, 2006

(30) Foreign Application Priority Data

Mar. 4, 2003 (IT) ..... MI2003A0382

(51) Int. Cl.
*C25C 1/12* (2006.01)
*C25C 7/00* (2006.01)

(52) U.S. Cl. ..... 205/348; 205/575; 205/582

(58) Field of Classification Search ..... None
See application file for complete search history.

(56) References Cited

U.S. PATENT DOCUMENTS

| | | | | |
|---|---|---|---|---|
| 3,974,049 | A | 8/1976 | James et al. | |
| 3,994,785 | A | 11/1976 | Rippere | |
| 4,088,556 | A | 5/1978 | Pellegri et al. | |
| 4,159,232 | A * | 6/1979 | Bacon et al. | 75/356 |
| 4,645,578 | A | 2/1987 | Suarez-Infanzon et al. | |
| 5,705,048 | A * | 1/1998 | Oxley et al. | 205/345 |

FOREIGN PATENT DOCUMENTS

WO WO2004/007805 1/2004

OTHER PUBLICATIONS

Jiricny et al, "A Study of the spouted-bed electrowinning of copper", 1999 (no month available), Proceedings of the Copper99 International Conference: vol. III-Electrorefining and Electrowinning of Copper, The Minerals, Metals and Materials Society, pp. 629-641.*

D. J. MacKinnon et al, "Factors affecting the structure of copper deposits electrowon from aqueous chloride electrolyte", 1985, Journal of Applied Electrochemistry, vol. 15, pp. 649-658.*

W. C. Cooper, "Advances and future prospects in copper electrowinning", 1985, Journal of Applied Electrochemistry, vol. 15, pp. 789-805.*

* cited by examiner

*Primary Examiner*—Harry D Wilkins, III
(74) *Attorney, Agent, or Firm*—Charles A. Muserlian

(57) ABSTRACT

A method for the production of metallic copper in a substantially dendrite-free crystalline form is described, comprising an electrowinning from a cuprous and/or cupric chloride solution carried out in a spouted bed cell comprising a cathode consisting of a descending bed of metallic beads.

11 Claims, No Drawings

METHOD FOR COPPER ELECTROWINNING IN HYDROCHLORIC SOLUTION

This application is a 371 of PCT/EP2004/002092 filed Mar. 2, 2004.

The primary deposition of copper at the cathode of an electrochemical cell (electrowinning) is a widely known process in the field of electrometallurgy. This type of process is commonly carried out on acidic solutions deriving from the attack of a copper mineral; in particular, the most important source of copper is chalcopyrite, a mixed copper and iron sulphide ($CuFeS_2$) of characteristic tetragonal crystals, often associated to other copper minerals suited to the scope such as covellite (cupric sulphide, CuS, hexagonal) and bornite (other mixed copper and iron sulphide, $Cu_5FeS_4$, cubic). Other important sources of copper are represented by synthetic sulphides, in particular by the material, known as matte, consisting of a raw mixture of fused sulphides obtained as an intermediate product in the melting of copper minerals. Almost in all the cases, these minerals are attacked with acids in order to obtain the cuprous ion in sulphuric solution, for instance by digestion with sulphonitric mixture, optionally coupled to roasting; said sulphuric solution is then subjected to electrolysis so that copper cathodic deposition is effected, while oxygen evolution occurs at the anode. Although this procedure is by now established, the energy consumption associated to copper electrowinning from sulphate is rather high; with the traditional lead anodes, the energy consumption associated to the electrowinning process is about 20-25 MJ per tonne of product copper, and the introduction, where possible, of noble metal oxide-coated titanium anodes mitigates the problem only in part. Also for this reason, that is to avoid worsening the overall energetic efficiency by introducing too high overvoltages, the industrial copper electrowinning from sulphate in acidic solution must occur at a current density below 1 $kA/m^2$, preferably around 0.5 $kA/m^2$, as disclosed, for instance, in the recent international patent application WO 02/18676. Another limiting factor in the process current density is in any case the quality of the product obtained; there is in fact a critical current density for obtaining acceptable cathodic deposits, beyond which they become less dense and shiny, and in general commercially unacceptable. The high energy consumption mentioned above is largely associated to the fact that the cathodic deposition half-reaction involves a two electron process, namely the bivalent copper discharge to metallic copper. A decisive factor for mitigating the energy consumption can be given by carrying out the copper cathodic deposition from a cuprous solution (monovalent copper), since besides the more favourable redox potential ($E_0$ of the reaction $Cu^+ + e \rightarrow Cu$ of 0.522 V NHE, against 0.340 V associated to the bivalent copper discharge according to $Cu^{++} + 2e \rightarrow Cu$), the deposit of one mole of copper implies the transfer of a single mole of electrons instead of two. Nevertheless it is not possible to operate with monovalent copper in a sulphuric environment: the fact that the cuprous ion has a higher reduction potential than the cupric ion is an indication of its natural tendency to disproportionate to metallic copper and cupric ion; particular conditions must therefore be realised for the cuprous ion to be stable enough to be employed for the electrochemical deposition. The industrially simplest way to obtain a stable electrolytic bath with a sufficient cuprous ion concentration is operating in a hydrochloric environment with a strong excess of chloride ions, which exert a complexing action displacing the equilibrium of the disproportionation reaction $2Cu^+ \leftrightarrow Cu^{++} + Cu$ in a suitable fashion. To get to this point, the copper mineral is attacked in the presence of chlorine, which oxidises sulphide to elemental sulphur permitting the withdrawal thereof; some purification cycles are then performed allowing, as a main consequence, the separation of iron, until obtaining a hydrochloric solution containing a mixture of cuprous and cupric chloride, optionally added with sodium chloride so as to maximise the content of monovalent copper.

Alternatively, the mineral may be attacked with an acidic solution of cupric chloride optionally containing dissolved chlorine, again with a subsequent separation of iron. In both cases, the typical solution obtained to be later subjected to the electrowinning process contains 5 to 75 g/l of $Cu^+$ ion together with 60-300 g/l of NaCl and about 1 M hydrochloric acid, in any case with pH not higher than 2.

In this way the energy consumption for copper electrowinning results sensibly reduced, however it is known to the experts in the field that the quality of the deposit obtainable from such solution with cells of the state of the art, having electrodes with fixed planar geometry, is remarkably inferior than the product obtained from sulphate. While it is true, as mentioned above, that the deposition from sulphate must occur at current densities not higher than 1 $kA/m^2$ also for a problem of coherency and brightness of the deposit, when operating in a chloride environment, even at very low current density, a remarkable dendrite formation is observed giving the product an insufficient consistency and an opaque aspect, generally unfit for commercialisation, also for the difficulties of washing and subsequently melting the product itself.

It is an object of the present invention to provide a method for copper electrowinning from hydrochloric solutions overcoming the drawbacks of the prior art.

Under one aspect, it is an object of the present invention to provide a method for the electrowinning of metallic copper in a substantially dendrite-free crystalline form, characterised by improved energetic efficiency.

Under another aspect, it is an object of the present invention to provide a method for the electrowinning of copper in a crystalline form at a current density higher than 1 $kA/m^2$.

Under one aspect, the invention consists of a method for the production of metallic copper from a hydrochloric solution, preferably containing cuprous chloride and optionally cupric chloride, comprising the deposition on a cathode consisting of a descending bed of progressively growing metallic beads.

Under a second aspect, the invention consists of a method for the production of metallic copper and chlorine from a hydrochloric solution supplied to a cell with cathodic spouted bed of metallic beads and planar anode separated by a semi-permeable diaphragm, preferably with re-use of the anodic product for attacking the copper mineral employed for the production of said hydrochloric solution.

This and other aspects will be clarified by the following description and the examples, which have the purpose to permit the comprehension of the invention without constituting a limitation thereof.

The inventors have surprisingly observed that it is possible to obtain a coherent, shiny and compact cathodic deposit of crystalline copper from hydrochloric solutions making use of a cell with cathodic spouted bed of progressively growing copper beads, even at a current density higher than 1 $kA/m^2$. Cells of this type, preferably employing a catalytically coated titanium or other valve metal planar element as the anode, and an element permeable to the liquid flow but not to the metallic beads as the separator, are disclosed in the co-pending Italian Patent Application MI2002A001524, incorporated herein as reference. It is known in the electrometallurgical field the use of spouted bed cells for the deposition of various metals in acidic solution, in processes providing oxygen evolution as the anodic half-reaction. Conversely, the anodic half-reaction of chlorine evolution, deriving from the use of chloride ion-containing electrolytes, was practically not explored in this context, also for its scarce feasibility deriving from the production of chlorine in metallurgic environments, wherein an employment for this gas is not usually contemplated. Nevertheless, in the case of copper electrowinning, the product chlorine reacts at least in part with the excess of monovalent copper of the electrolyte, producing cupric chloride; in case of strong cuprous ion excess, the net anodic reaction is simply the oxidation of monovalent to bivalent copper, without a net production of chlorine taking place. In any case the anodic product, consisting of a solution enriched in cupric chloride and depleted in cuprous chloride optionally containing dissolved chlorine, can advantageously be sent back to the reactor which accomplishes the primary digestion of the ore, allowing in the most favourable of cases to operate virtually at closed cycle. The possible presence of free chlorine necessarily entails an accurate selection of the construction materials, due to the high corrosive power of this gas, and also of the catalyst directed to the activation of the anodic half-reaction. All the components of the anodic compartment must therefore be constructed with titanium or other valve metal, as known in the art of the industrial electrolytic cell design; also the anode will hence consist of a titanium, or titanium alloy or other valve metal planar and preferably perforated element, provided with a suitable catalytic coating. The latter is preferably based on noble metals, for instance ruthenium, platinum or iridium, often in form of oxides, and often mixed with oxides of valve metals such as tantalum or titanium, as known in the field of chlorine evolution electrocatalysis. The semipermeable diaphragm may be a planar element consisting of any insulating material, or electrically insulated on at least one face, capable of resisting the highly corrosive conditions inside the cell, an provided, at least on the side facing the cathodic bed of metallic beads, with suitable holes or porosities capable of segregating the beads themselves, preventing their migration to the anodic compartment while allowing the flow of liquid electrolyte. Particularly preferred materials are the chlorine-resistant polymer webs, usually obtained from perfluorinated polymers, or from inorganic fibres (for instance based on zirconium oxide) bound with perfluorinated polymers (for instance polytetrafluoroethylene); however, in case the process is regulated so as to obtain an anodic product substantially lacking free chlorine (that is with a monovalent copper excess allowing the almost complete conversion thereof to cupric chloride), it is possible to use separators based on non fluorinated polymers such as polyester, polyethylene or polypropylene. When the growing copper beads reach the provided diameter, they can be discharged from the cell in batches, or by means of a continuous process, as disclosed in the same cited patent application. By operating in this way, a shiny and coherent deposit is obtained up to current densities of 4 kA/m$^2$, even though for energy consumption reasons it is often chosen to carry out the process at slightly lower current densities. Contrarily to the dendritic deposit obtainable in a traditional planar cathode electrowinning cell, the beads thus obtained are regular and easier to handle. Moreover, they can be more easily rinsed to withdraw the electrolyte residues at the end of the operation, and also the optional melting step for their subsequent re-use results greatly facilitated.

Without wishing the extent of the present invention to be bound to any particular theory, it can be assumed that this surprising effect of the deposition in a descending bed of growing beads result free of dendrites because such beads are effectively affected by the electric field only for a few seconds at a time, which is sufficient for the nucleation of copper crystals but not for their growth in a dendritic form. The stirring itself may be a factor assisting the crystal growth regularity, as known to the experts of the field who use air insufflation, or equivalent stirring means, to raise the critical current density in the different processes of primary deposition of metals; however, the extent of the result achieved with this type of cell indicates that the simple stirring cannot be the sole responsible factor for obtaining a high quality copper deposit from a chloride solution, especially at so elevated current densities.

EXAMPLE 1

A 60 cm$^2$ active area spouted bed cell was assembled according to the geometry described in MI2002A001524. A titanium based DSA® anode with a ruthenium and tantalum oxide-based coating was used at the anode compartment. A 0.25 mm thick polyethylene porous web, commercialised by Daramic®/USA as a separating element for batteries, was used as the separator. The cell was supplied in both compartments with a solution containing 30 g/l of cuprous ion and 1 M HCl at 48° C. After starting the electrolyte circulation in the cathodic compartment, the latter was fed with 1-2 mm diameter copper beads, and the flow-rate was adjusted in order to have a uniform descending bed of beads. A current density of 2.5 kA/m$^2$ was applied, which gave rise to a cell voltage of 2.2 V. The test was discontinued after 100 minutes, and a current efficiency of 61% was determined. The visual inspection of the product evidenced a typical sample of crystalline and coherent copper deposit. The scanning electron microscope test evidenced no dendrite formation.

EXAMPLE 2

The test of example 1 was repeated adding 75 g/l of sodium chloride to the electrolyte. After 180 minutes, a current efficiency of 67% was detected. The formation of a coherent and shiny deposit was again detected, with no trace of dendrites.

The invention claimed is:

1. A method for electrowinning dendrite-free crystalline copper at a current density of at least 1 kA/m$^2$ from a hydrochloric solution of cuprous and cupric chloride, the solution being obtained by attacking a copper ore in the presence of chlorine, wherein the method comprises the step of depositing the copper on a cathode consisting of a descending bed of metallic beads.

2. The method of claim 1 wherein said bed is separated from the relevant anodic compartment by mean of a semipermeable diaphragm allowing electrolyte circulation while hindering the passage of said metallic beads from the cathodic compartment to said anodic compartment.

3. The method of claim 2 wherein said semipermeable diaphragm is an optionally perfluorinated polymer web or a web obtained from fibers of zirconium oxide or other chlorine-resistant inorganic material bound with a perfluorinated polymer.

4. The method of claim 2, comprising the formation of an anodic product containing cupric chloride and optionally dissolved chlorine.

5. The method of claim 4, wherein said anodic compartment comprises a titanium or other valve metal anode with a catalytic coating containing noble metals and/or oxides thereof.

6. The method of claim 4, comprising employing said anodic product for attacking a copper ore with formation of said cuprous chloride and optionally containing cupric chloride solution used in said electrowinning.

7. The method of claim 6 wherein said copper ore is selected from the group consisting of chalcopyrite, chalcocyte, bornite, covellite, matte and synthetic sulfides.

8. The method of claim 1 wherein said cuprous chloride solution, optionally containing cupric chloride, is an aqueous solution comprising hydrochloric acid and optionally sodium chloride.

9. The method of claim 8 wherein said solution has a pH not higher than 2 and comprises 5 to 75 g/l of cuprous ion.

10. The method of claim 9 wherein said solution further comprises 60 to 300 g/l of sodium chloride.

11. The method of claim 1 wherein said electrowinning is carried out at a current density between 1000 and 4000 $A/m^2$.

* * * * *